US005147089A

United States Patent [19]

Anderson

[11] Patent Number: 5,147,089

[45] Date of Patent: Sep. 15, 1992

[54] GOLF BAG STAND

[75] Inventor: Victor R. Anderson, Trumbull, Conn.

[73] Assignee: Loctec Corporation, Monroe, Conn.

[21] Appl. No.: 819,956

[22] Filed: Jan. 13, 1992

Related U.S. Application Data

[63] Continuation-in-part of Ser. No. 727,869, Jul. 10, 1991.

[51] Int. Cl.[5] ..... A63B 55/00

[52] U.S. Cl. ..... 248/96; 206/315.7; 280/DIG. 6

[58] Field of Search ..... 248/170, 171, 168, 169, 248/409, 96; 280/DIG. 6, 646, 47.18; 206/315.7

[56] References Cited

U.S. PATENT DOCUMENTS

| | | | |
|---|---|---|---|
| 1,176,031 | 3/1916 | Cady | 248/96 X |
| 1,752,114 | 3/1930 | Shaw | 248/96 |
| 2,572,408 | 10/1951 | Hoek | 248/96 X |
| 4,620,682 | 11/1986 | Yim | 280/DIG. 6 |
| 4,676,464 | 6/1987 | Reimers | 206/315.7 X |
| 4,834,235 | 5/1989 | Solheim | 206/315.7 |
| 4,921,192 | 5/1990 | Jones | 248/96 |
| 4,949,844 | 8/1990 | Yang | 206/315.7 |
| 5,036,974 | 8/1991 | Ross | 206/315.7 |

*Primary Examiner*—J. Franklin Foss
*Attorney, Agent, or Firm*—Haynes N. Johnson

[57] ABSTRACT

A golf bag stand having both an actuated state and a disabled state. The bag has two legs pivotally mounted side by side at the top of the bag. Two spring arms are secured at their lower ends to a control block and at their upper ends are pivotally secured to the legs. A projector is slidingly mounted within the control block and extends downwardly from the control block. It can be secured in two different positions. When the stand is in its disabled state, the projector does not extend beyond the base of the bag; when in its actuated state, the projector extends two to three inches below the base of the bag. When the device is in its actuated state and the user puts the bag down on its base, the projector touches the ground and is forced upwardly relative to the bag. This forces the legs to swing outwardly, forming, with the bag itself, a tripod-like stand for the bag.

15 Claims, 6 Drawing Sheets

GOLF BAG STAND

This application is a continuation-in-part of application Ser. No. 07/727,869, filed Jul. 10, 1991.

FIELD OF THE INVENTION

This invention relates to the field of golf bag stands and, in particular, stands which are self-opening when a bag is being put down, self-closing when the bag is picked up, and which can be easily disabled when desired.

BACKGROUND OF THE INVENTION

Various golf bag stands exist with some type of structure that will open and close when the bag is put down or raised. None, however, appear to have a simple disabling feature to make them inoperative when their function is not wanted.

Yim U.S. Pat. No. 4,620,682 discloses a form of golf bag stand that can be disabled, but it requires the use of a fixed center shaft mounted to the bag along the length of the bag. This shaft, however, adds unnecessary weight and expense to the stand.

BRIEF SUMMARY OF THE INVENTION

My invention is a golf bag stand which has both an actuated (enabled) state, for use when playing golf, and a disabled state, for use when the golf bag is being stored. In use, the stand and bag form a supporting tripod for the bag when the user puts it down.

In the principal embodiment, the bag has two legs pivotally mounted side by side on the cuff at the top of the bag. Each leg carries a sliding bracket which can be held in two positions: a disabled position near the top of the legs, and an actuating position two to three inches farther down the leg. The two arms of a V-shaped spring push rod fit within the bracket, the arms being spring-pressed towards one another. The lower end of this member forms a projector which slides within a bracket mounted on the cuff at the base of the golf bag. When the stand is in its disabled state, the projector does not extend beyond the base of the bag; when in its actuated state, the projector extends two to three inches below the base of the bag.

In the present modifications, the bag has two legs pivotally mounted side by side on the cuff at the top of the bag. Each leg is pivotally connected to a spring arm; and the two arms extend downwardly and come together in a control block. The control block slidingly carries a downward projector which can be held in two positions: an actuating (enabling) position in which it extends below the bottom of the bag and a disabled position in which it does not so extend.

The two spring arms and control block form a V-shaped spring, the arms being spring-pressed towards one another. The lower end of this member forms a projector which slides within a bracket mounted on the cuff at the base of the golf bag. When the stand is in its actuated state, the projector extends two to three inches below the base of the bag.

When the device is in use, i.e., in its actuated state, and the user puts the bag down on its base, the projector touches the ground and is forced upwardly relative to the bag. This forces the legs to swing outwardly, forming, with the bag itself, a tripod-like stand for the bag. It also causes the legs and arms of the V-shaped push rod to spread apart from each other, acting against the springiness of the member. When the bag is again picked up, the arms tend to come together, causing the legs to retract and the projector to again be extended. The bag can then be carried.

In its disabled state, with the sliding brackets in their upper position, the projector does not extend beyond the bottom of the bag. As a result, putting the bag down does not cause the legs to extend.

The projector slides within the control block and can be secured in two positions, an upper disabled position and a lower enabled (actuated) position.

DETAILED DESCRIPTION OF THE INVENTION

My golf bag stand has two states, actuated (enabled) and disabled. In the former, when the bag is put down, legs will extend outwardly from the bag forming, with the bag itself, a tripod stand. When the bag is picked up, the legs will retract to a position flush with the bag. When the stand is disabled, the legs will not extend outwardly when the bag is put down.

Figure 1:
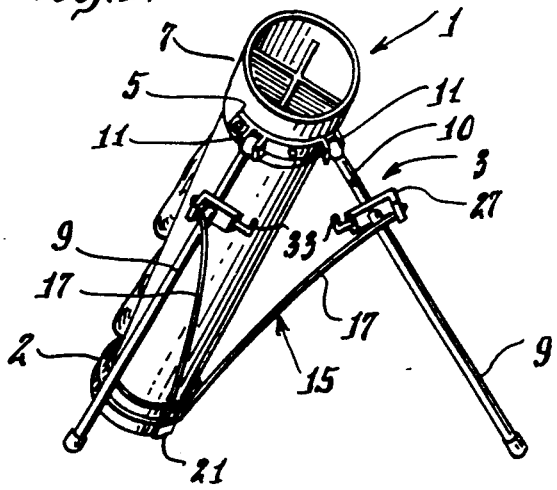
FIG. 1 is a perspective view of my golf bag stand as it would be seen in use supporting a bag.
Figure 3:
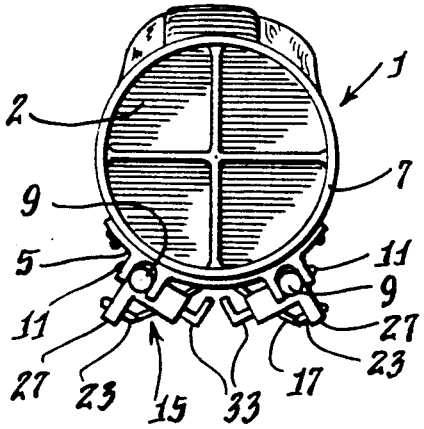
FIG. 3 is a top plan view of the stand, again disabled.

FIG. 1 shows my golf bag 1, with base 2, being supported by my stand 3. The upper end of the stand has a collar 5 which is secured to the cuff 7 on the top of the bag. The legs 9 of the stand are pivotally attached to the collar at pivots 11. A V-shaped spring push rod 15 can push the legs outwardly about the pivots. Since the pivots 11 are on different parts of the periphery of the cuff 7, they have axes which are at an angle to one another, causing the legs to spread as they are pushed outwardly. Legs 9 and base 2, i.e., the bottom projector end of the V-shaped push rod, form a tripod support for the bag.

Push rod 15 is made of steel or spring steel. It has a U-shaped base section 19 (projector) and upwardly extending arms 17, the latter terminating in upper angled ends 23. Springiness in rod 15 causes the two arms 17, and the two ends 23 tend to move towards each other to an extent that, were the push rod 15 not mounted in the stand, the arms and their ends would come together. Projector 19 fits within an opening 22 in a bracket 21 which is secured to the cuff at base 2 of the bag. When the stand is in its disabled state, projector 19 does not extend beyond the base 2; when in actuated state, projector 19 will extend beyond the base by about two to three inches.

Each of legs 9 carries a sliding bracket 27. Each of the brackets 27 has a hole 28 in it to receive and slidingly fit about its respective leg 9. Each bracket also has an opening 29 to receive and hold one of the upper angled ends 23 of the V-shaped member 15. Ends 23 can be held in position in openings 27 with bolts or in any other desired manner. Ends 23 should, however, be able to twist slightly within openings 27.

Brackets 27 each have a recess 31 to receive a pin 33 with a collar 35 about it. Pins 33 have angled outer ends or handles 34 by which they can be grasped. There is a spring 37 about each pin which presses against the collar and so pushes the pin outwardly.

Legs 9 each have two holes in them, an upper disabling hole 10 proximate to the top of the legs, and a slightly lower actuating hole 41. These holes are so positioned and so spaced that they can used in conjunction with bracket pins 33 to keep the stand in disabled state (using holes 10) or in actuating state (using holes 41). Upper hole 10 need not always be used, since, in the disabled state, friction from the spring pressure of push rod 15 may be adequate to hold the sliding brackets 27 in place on legs 9.

The pins 33 are so positioned that they will press into hole 10 or hole 41 when the bracket 27 is slid along leg 9 so that the pins are in alignment with one hole or the other.

Though I have shown a pin and hole structure for holding the sliding brackets 27 in position on legs 9, other structures such as spring-pressed detents could be used. The important thing is that, whether in the upper disabled state or in the lower actuated state, the upper ends of the V-shaped push rod 15 be held against sliding movement relative to legs 9 as long as the stand is in one state or the other.

Figure 2:
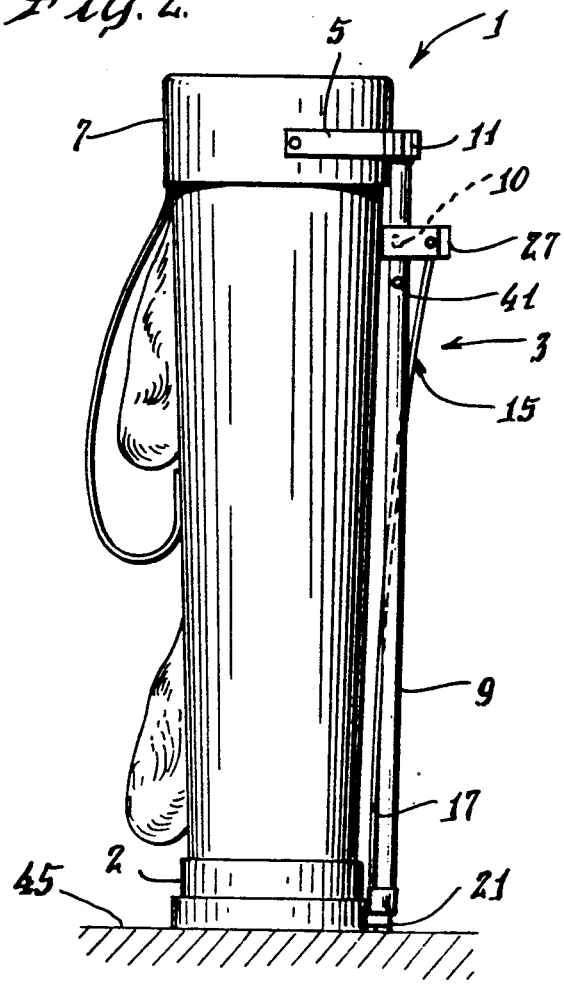
FIG. 2 is a side elevation of the stand when disabled.
Figure 4:
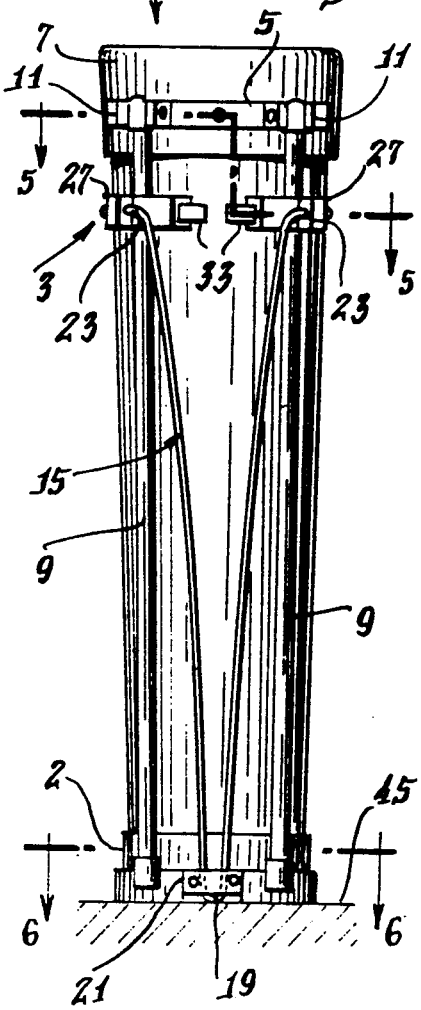
FIG. 4 is a front elevation of the stand, again disabled.
Figure 5:
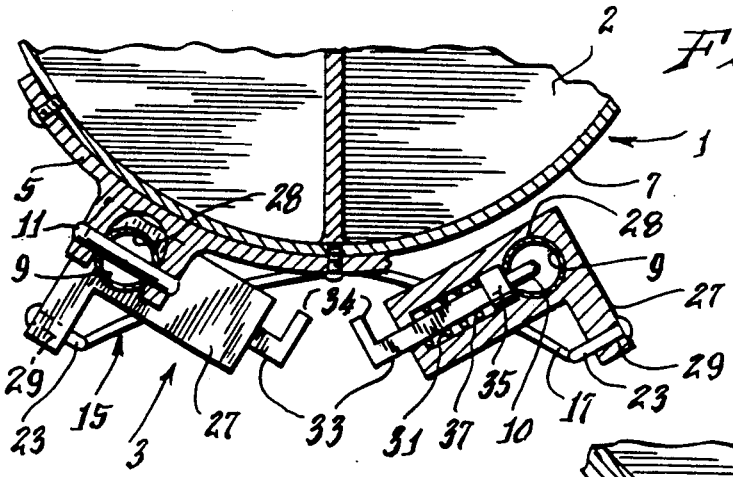
FIG. 5 is a horizontal section, taken on line 5—5 of FIG. 5.
Figure 6:
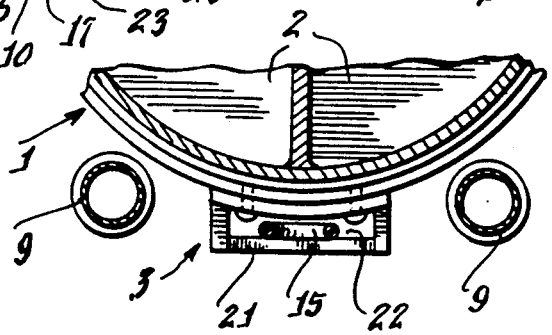
FIG. 6 is a horizontal section, taken on line 6—6 of FIG. 4.

When one is not playing golf, he does not want the stand to operate. Therefore, he disables the bag by taking handles 34 and pulling them towards each other, removing the pins 33 from holes 41 in the legs. This allows brackets 27 to be lifted upwardly along legs 9 until the brackets are opposite upper, disabling holes 10. The pins can then be allowed to press into those holes. The stand will then be collapsed and have the appearance seen in FIGS. 2 and 4, with the lower end of the V-shaped member, projector 19, not projecting beyond base 2. The golf bag can then be stood on its base 2 for storage without actuating the stand.

Figure 8:
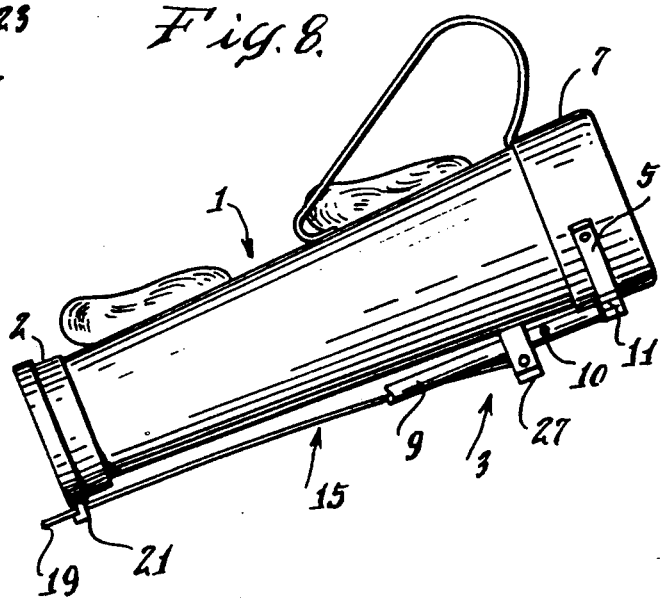
FIG. 8 is a side elevation of the bag, with the stand actuated (enabled), but as it would appear (closed) while the bag is being carried.

When one is playing golf, the stand should be in its actuated state. This is done by removing the pins 33 from the disabling holes 10 and sliding the brackets 27 downwardly until the pins fit within actuating holes 41. This causes projector 19 to extend beyond the base of the bag, as seen in FIG. 8.

Figure 7:
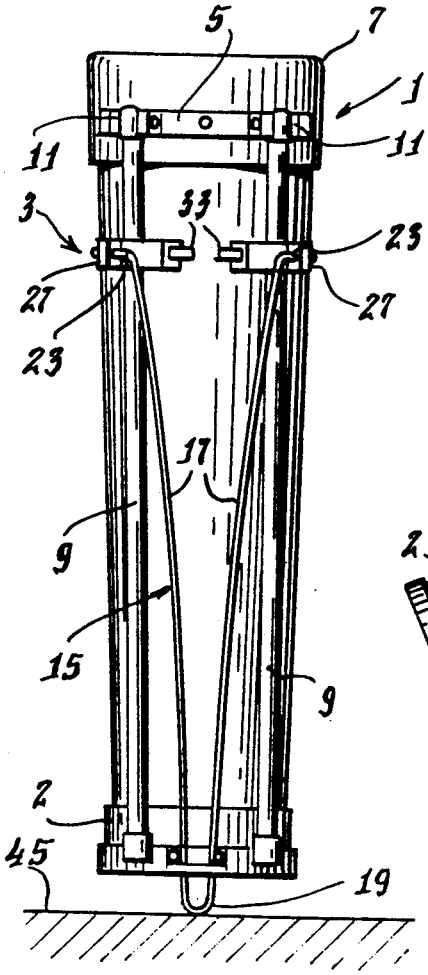
FIG. 7 is a front elevation of the stand, actuated and no longer disabled, and shown as the bag is being placed on the ground. Continuing to lower the bag will cause the stand to open.
Figure 10:
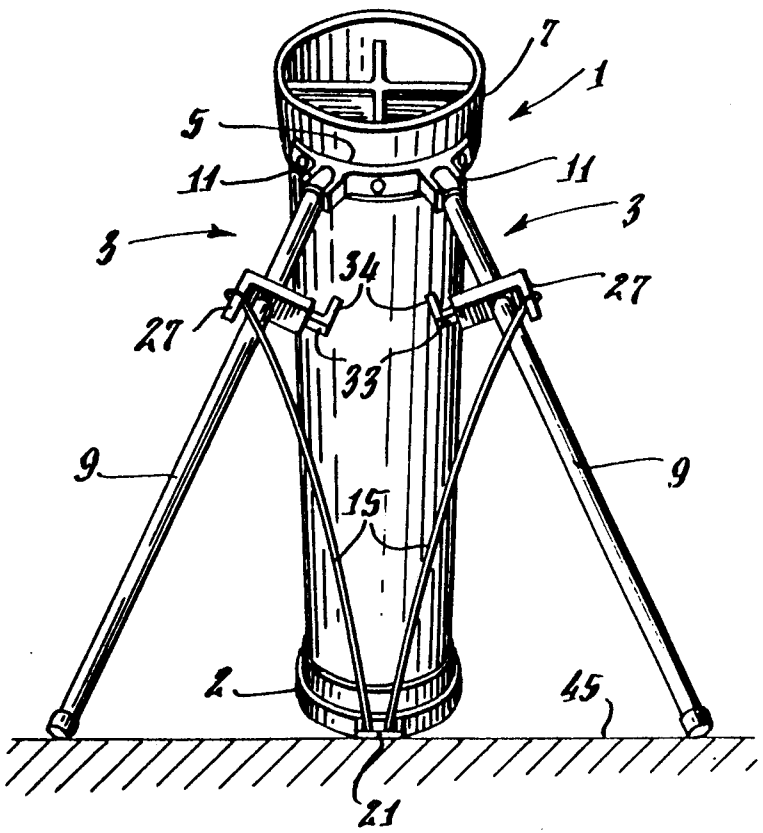
FIG. 10 is a front elevation, again of the stand supporting the bag.
Figure 9:
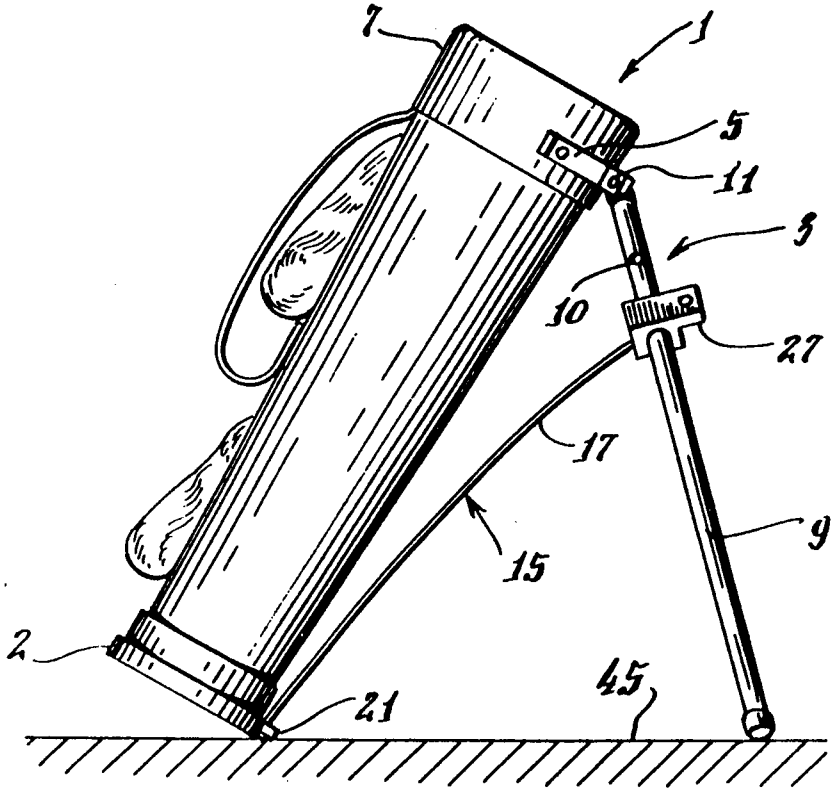
FIG. 9 is a side elevation of the stand supporting the bag. The stand is actuated.
Figure 11:
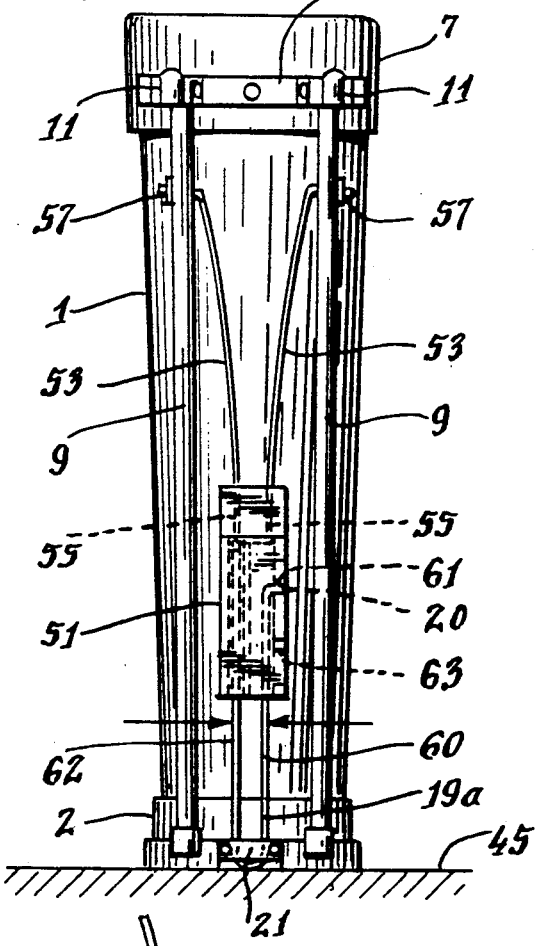
FIG. 11 is a front elevation of a first modification of my invention showing the golf bag stand in its disabled condition.
Figure 12:
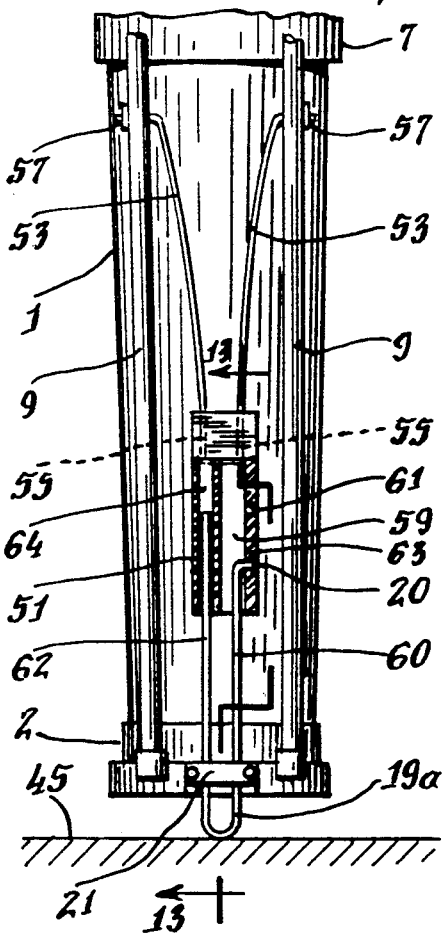
FIG. 12 is a similar front elevation thereof, partially cut away, showing the golf bag stand in its enabled condition and raised from the ground.
Figure 13:
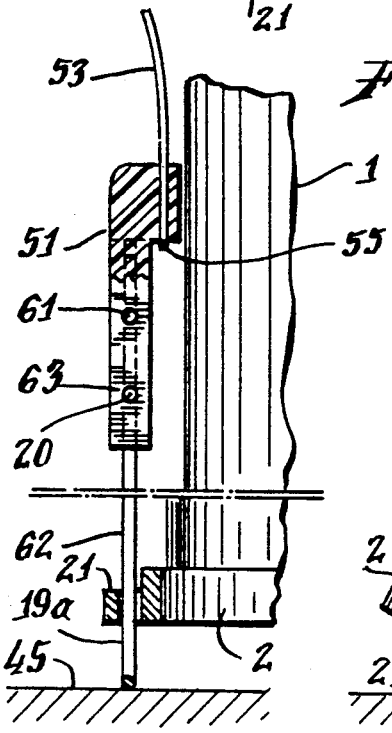
FIG. 13 is a section thereof, taken on line 13—13 of FIG. 12.
Figure 14:
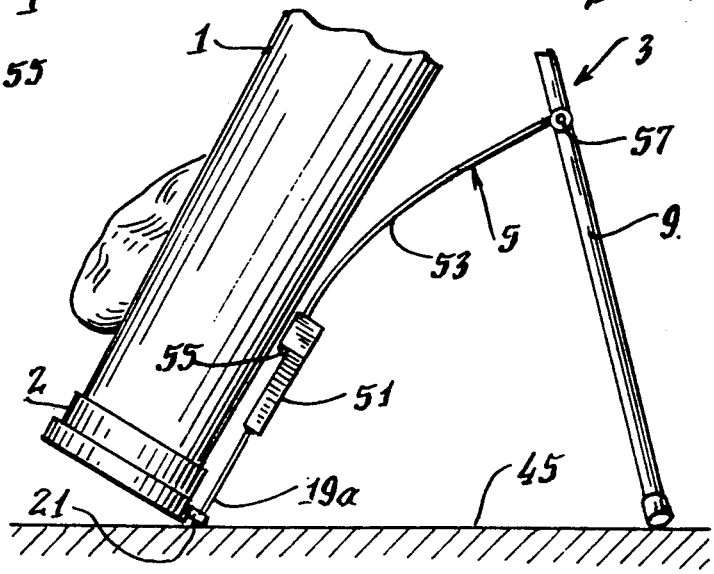
FIG. 14 is a partial side elevation thereof showing the stand in use supporting a golf bag.
Figure 15:
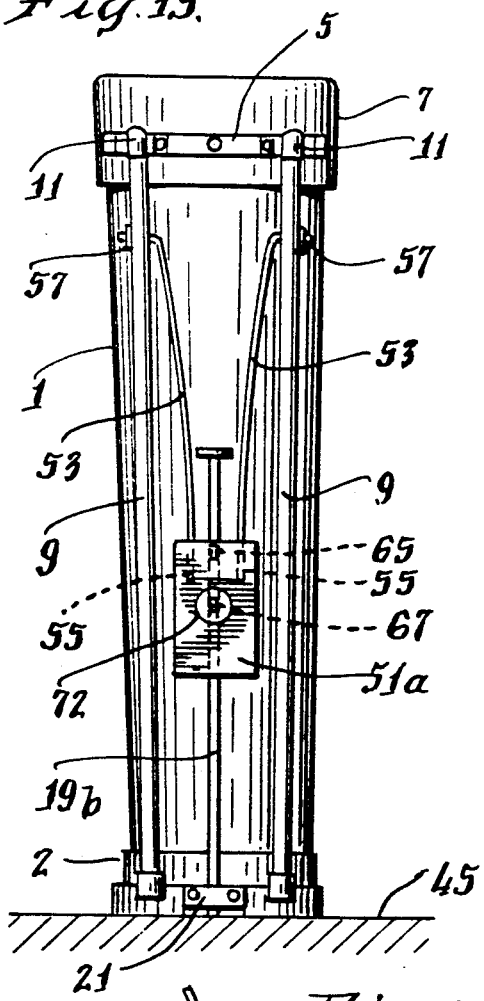
FIG. 15 is a front elevation of a second modification of my invention showing the golf bag stand in its disabled condition.
Figure 16:
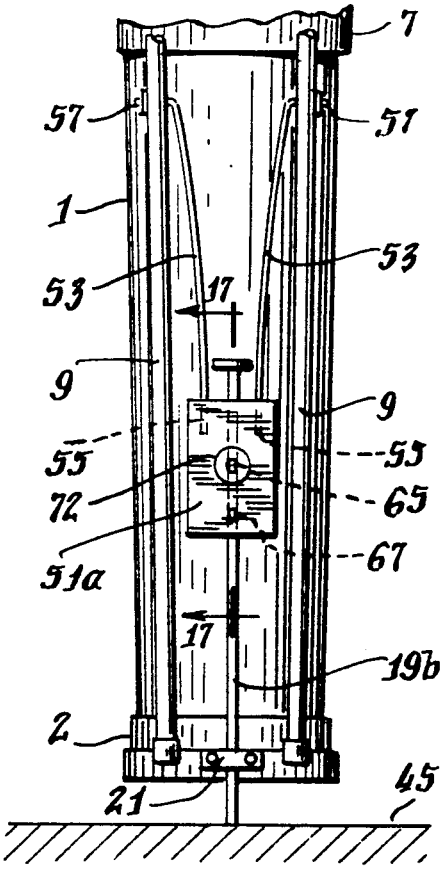
FIG. 16 is a similar front elevation thereof, showing the golf bag stand in its enabled condition and raised from the ground.
Figure 17:
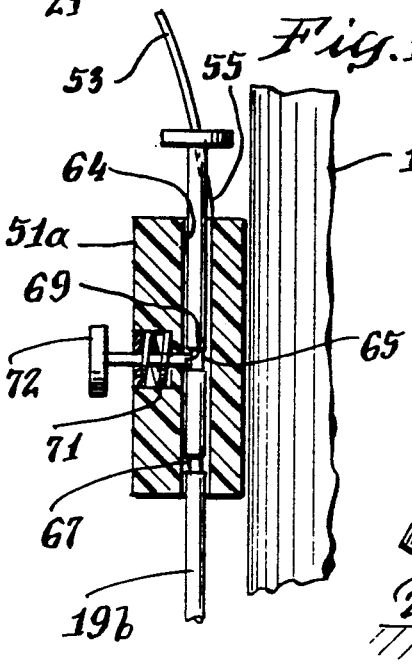
FIG. 17 is a section thereof, taken on line 17—17 of FIG. 16.
Figure 18:
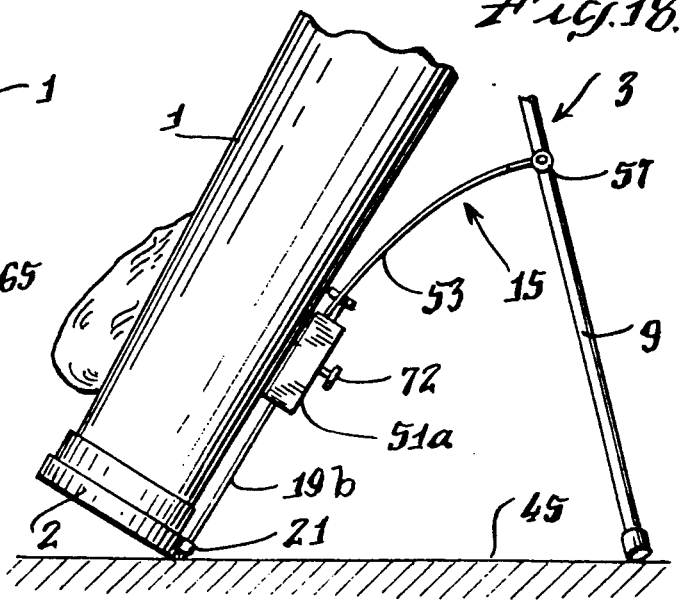
FIG. 18 is a partial side elevation thereof showing the stand in use supporting a golf bag.
Figure 19:
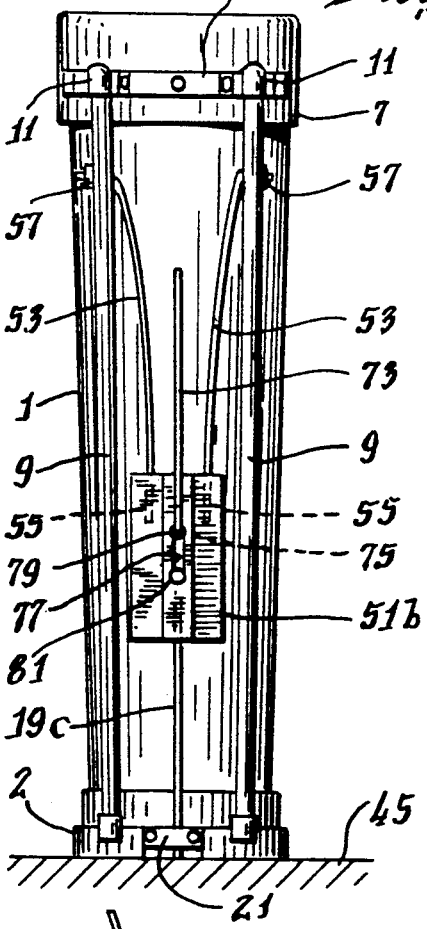
FIG. 19 is a front elevation of a third modification of my invention showing the golf bag stand in its disabled condition.
Figure 20:
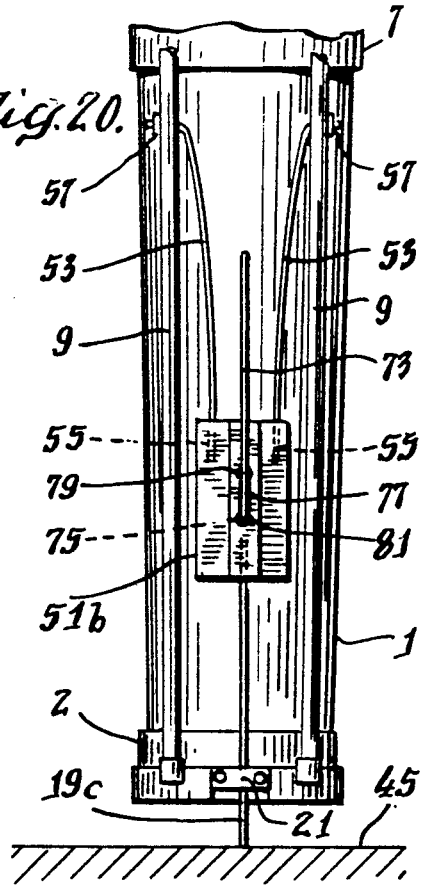
FIG. 20 is a similar front elevation away, showing the golf bag stand in its enabled condition and raised from the ground.
Figure 21:
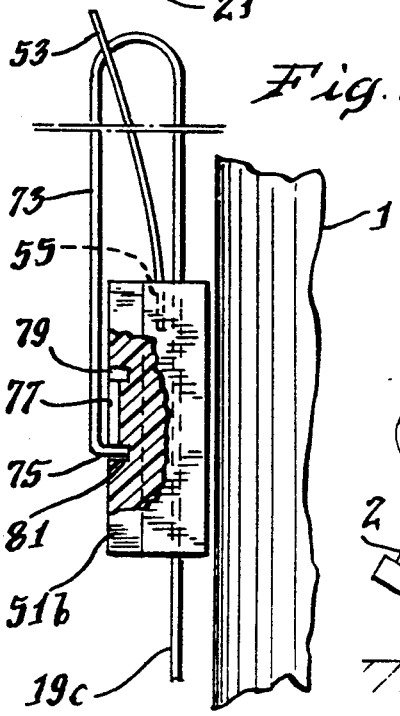
FIG. 21 is a side elevation thereof, partially broken away.
Figure 22:
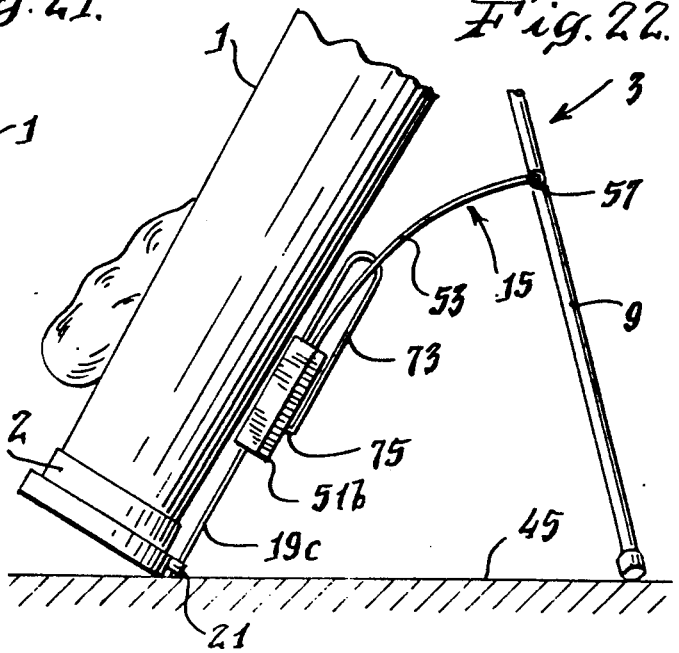
FIG. 22 is a partial side elevation thereof showing the stand in use supporting a golf bag.

Now, placing the base upon the ground (as is being done in FIG. 7) will cause projector 19 and V-shaped push rod 15 to be pushed upwardly (FIG. 19). Since the member 15, restrained by brackets 27, cannot slide upwardly on legs 9, it forces the legs to pivot outwardly. At the same time, since the angle of the pivots 11 of legs 9 will not permit the two legs to remain parallel, the lower ends of legs 9 spread apart. This results in the bag and the two legs forming a tripod, which makes a stand for the bag (FIGS. 9 and 10). At the same time, the arms 15 are spread apart against their spring-pressed normal condition close to one another.

When the bag is again picked up, there will be nothing pressing projector 19 upwardly. As a result, the spring pressure in arms 17 cause them to press towards each other, driving projector 19 downwardly and, so, collapsing the stand, returning it to the position shown in FIG. 8.

Three modifications of my invention are shown in FIGS. 11 to 14, 15 to 18, and 19 to 22 respectively. The structure and operation of each modification is generally similar to the above-described principal embodiment golf bag stand. However, the structure of the projector and the systems for enabling and disabling the projector are different.

Each of the modifications uses a control block (51, 51*a*, or 51*b*) for holding, and for enabling and disabling, the projector (19*a*, 19*b*, or 19*c*). The springs (which operate in a manner similar to push rod 15 of the principal embodiment) are two spring arms 53, the lower ends 55 of which are secured in the control block (by adhesive or otherwise) and their upper ends 57 are pivotally connected to the two legs 9 with horizontal pivots.

In the first modification (FIGS. 11 to 14) control block 51 has a wide slot 59 entering it from below. The slot has a laterally-extending upper hole 61 and a laterally extending lower hole 63. The projector 19*a* is a U-shaped member (similar to projector 19 of FIG. 4), except that the upper end of one side 60, which extends into slot 59, has an outwardly-extending finger 20 to be received in holes 61 and 63. The other side 62 of the projector moves within slot 64. The arms of projector 19*a* are slightly spring-pressed away from one another, so as to hold the finger 20 within its hole.

In use, when finger 20 is in upper hole 61, the unit is disabled, and the projector does not extend below the golf bag. To enable the stand, the user squeezes the upper end of the projector together, removing the finger 20 from hole 61 and lowering the unit in the slot so that finger 20 is placed in lower hole 61. The projector 19*a* then extends below the bottom of the golf bag in its actuated position. Putting the bag down, forces the projector 19*a* upwardly, causing the stand to open, as with the stand of the principal embodiment. Likewise, picking up the bag causes the stand to close, as before. To then disable the stand, the upper ends of the projector 19*a* are squeezed together to remove the finger 20 from lower hole 63, and the finger is placed in upper hole 61.

The second modification is shown in FIGS. 15 to 18. Here the projector 19*b* is a rod which slides through a vertical hole 64 in control block 51*a*. The projector rod has two peripheral notches in it, upper notch 65 and lower notch 67. A pin 71 with a knob 72, mounted on control block 51*a*, is spring-pressed inwardly by spring 71 to press against the projector rod and to interengage with notches 65 and 67. When pin 71 is in the upper notch, the projector 19*b* extends beyond the bottom of the golf bag, and the unit is in its actuated or enabled position. When the pin is in lower notch 67, projector 19*b* does not so extend, and the stand is disabled. It should be noted that lower notch 67 can be eliminated, if desired, since friction between pin 69 and the rod of projector 19*b* will ordinarily be sufficient to hold the projector in its disabled position.

Aside from the differences noted above, this second modification operates in the same way as the first modification.

The third modification is shown in FIGS. 19 to 22. Projector 19*c* is again a rod and passes through a vertical slot 77 in control block 51*b*. After passing through the slot, and above the slot, projector 19*c* is bent 180° to form return arm 73 with a locking pin 75 on its end which is projected towards control block 51*b* and is spring-pressed inwardly toward control block 51*b*. The front face of control block 51*b* carries a vertical slot with an upper hole 79 and a lower hole 81 in the slot. Locking pin can then be positioned in either one of the holes. When it is in the upper hole, the unit is disabled; when in the lower hole, it is enabled. Otherwise, this modification works like the others.

It should be noted, with respect to all of the modifications, that the stand requires a positive linkage between the projector and the control block only for the enabled position. The upper holes and notches 61, 65, and 79 are not absolutely necessary for the disabled position, since a frictional grip usually suffices.

Accordingly, I have provided a golf bag stand which can have both actuated (enabled) and disabled states. The stand can, of course, be made as part of a golf bag or, alternatively, be manufactured separately for later attachment to the bag.

I claim:

1. A collapsible supporting stand for a golf bag, said stand having collapsed and erect positions and having actuating and disabling states, said stand including a collar securable to said bag proximate to the top thereof, a pair of legs pivotally secured to said collar side by side, a base bracket securable to the base of said bag, a control block between said legs, a pair of spring arms having their lower ends fixedly secured to said control block, and their upper ends pivotally secured one to each said leg, a projector vertically slidingly engaging said control block and extending below said control block, said projector sliding within said base bracket, and means for positively securing said projector in at least one position relative to said control block with said projector extending beyond said bracket when said stand is in its collapsed condition, whereby upward force on said projector, when said stand is in its actuating state, will erect said stand, and said stand can be made actuable or can be disabled.

2. A collapsible supporting stand for a golf bag as set forth in claim 1 including means for securing said projector in a second position relative to said control block with said projector not extending beyond said bracket.

3. A collapsible supporting stand for a golf bag as set forth in claim 1 in which said arms are spring-pressed towards one another, whereby, upon removal of force from said projector, said stand will be caused to collapse.

4. A collapsible supporting stand for a golf bag as set forth in claim 1 in which said means for positively securing said projector include having said projector be a U-shaped spring member with a finger extending outwardly from at least one upper end thereof, a slot in said control block for receiving said projector and permitting said sliding engagement therewith, and at least one hole in said slot for receiving said finger.

5. A collapsible supporting stand for a golf bag as set forth in claim 4 including at least two said holes, said holes being vertically displaced from one another.

6. A collapsible supporting stand for a golf bag as set forth in claim 1 in which said projector is a rod extending through said control block, said rod having at least one peripheral groove therein, and a spring-pressed pin in said control block, positioned so as to press against said rod and to interlock with said groove when said pin and said groove are in alignment with one another.

7. A collapsible supporting stand for a golf bag as set forth in claim 6 including two said peripheral grooves therein, one above the other, and the upper of said grooves serving, together with said pin, to position said projector in an enabled position.

8. A collapsible supporting stand for a golf bag as set forth in claim 1 in which said projector is a rod passing vertically through said control block and having a return arm folded back about the outside of said control block, and spring-pressed towards said control block, the lowermost end of said return arm being formed with a locking pin projecting towards said control block, and at least one opening in said control block positioned to receive said locking pin when said projector is positioned to place said golf bag stand in its said actuating state.

9. A collapsible supporting stand for a golf bag as set forth in claim 8 including two said openings in said control block to receive said locking pin, one said opening being above the other, said uppermost opening being positioned to receive said locking pin when said stand is in its said disabling state.

10. A stand for a golf bag, said stand having erect and collapsed positions, and said stand including a pair of legs, means for pivotally securing said legs to the upper part of said golf bag, a control block, a pair of spring arms having their lower ends fixedly secured to said control block, means for pivotally securing the upper end of one of said arms to one of said legs and the upper end of the other of said arms to the other of said legs, a projector slidingly fitting within said control block for up-and-down motion with respect to said control block, and means for securing said projector in two positions relative to said control block, one of said positions disabling said projector and the other of said positions enabling said projector, whereby, when said projector is secured at said enabling position, said projector will project below said bag and upward force thereon will cause said stand to come to its erect position.

11. A stand for a golf bag as set forth in claim 10 in which said legs, said arms, said projector, and said control block are so dimensioned and so positioned relative to one another and to said golf bag that said projector projects below said bag when said stand is in its actuating position and does not so project when said stand is its disabled position.

12. A stand for a golf bag as set forth in claim 10 in which said projector is a U-shaped member with upwardly extending arms and with a spring-pressed finger projecting outwardly from the top of said arm, a vertically-extending slot in said control block receiving said U-shaped member, and a hole in said slot to receive said finger.

13. A stand for a golf bag as set forth in claim 10 in which said projector is a rod with at least one peripheral groove therein, a spring-pressed pin in said control block positioned such that said pin presses against said rod and presses into said groove when said pin and said groove are in alignment.

14. A stand for a golf bag as set forth in claim 10 in which said projector is a rod passing vertically and slidingly through said control block, said rod bending downwardly above said control block whereby its end presses against the outside of said control block, and at least one hole on the outside of said control block to receive said end of said rod.

15. A golf bag having a self-erecting and self-collapsing stand thereon, said stand having an actuating state and a disabled state, said bag including a body portion having upper and lower cuffs therearound, a pair of legs hingedly mounted on said upper cuff such that said legs are parallel to one another when against said body portion and spread apart when hinged away from said body portion, a control block, a pair of spring arms having their lower ends secured to said control block and the upper end of one of said pair being pivotally secured to one of said legs and the upper end of the other of said pair being pivotally secured to the other of said legs, a projector mounted for vertical sliding movement relative to said control block, a bracket mounted on said lower cuff for slidingly holding said projector, and means for holding said projector in at least two different positions with respect to said control block, whereby, when said legs and said arms are pressing against said body portion, said projector extends below said cuff when said projector is held in one of said two different positions and said projector does not extend beyond said cuff when said projector is held in the other of said two different positions.

* * * * *